US006438759B1

(12) United States Patent
Jaunault et al.

(10) Patent No.: US 6,438,759 B1
(45) Date of Patent: Aug. 27, 2002

(54) METAL MESH GLOVES

(75) Inventors: Philippe Jaunault; Sophie Jaunault, both of Villemoisan; Jean-Pierre Bodard, Tharon-Plage, all of (FR)

(73) Assignee: Manulatex France, Champtoce sur Loire (FR)

( * ) Notice: Subject to any disclaimer, the term of this patent is extended or adjusted under 35 U.S.C. 154(b) by 0 days.

(21) Appl. No.: 09/647,164

(22) PCT Filed: Mar. 26, 1999

(86) PCT No.: PCT/FR99/00715

§ 371 (c)(1),
(2), (4) Date: Nov. 27, 2000

(87) PCT Pub. No.: WO99/49743

PCT Pub. Date: Oct. 7, 1999

(30) Foreign Application Priority Data

Mar. 27, 1998 (FR) ..... 98 04076

(51) Int. Cl.[7] ..... A41D 19/00
(52) U.S. Cl. ..... 2/167; 2/16; 2/162
(58) Field of Search ..... 2/159, 16, 20, 2/139, 167, 59, 162, 170, 910

(56) References Cited

U.S. PATENT DOCUMENTS 1,736,928 A * 11/1929 Lowe ..... 2/159
4,004,295 A * 1/1977 Byrnes, Sr. ..... 2/161
4,388,733 A * 6/1983 Anstett ..... 2/161
4,471,495 A * 9/1984 Kruse et al. ..... 2/162
4,507,353 A * 3/1985 Kuhlmann et al. ..... 428/222
5,088,123 A * 2/1992 MacDonald ..... 2/162
D348,141 S * 6/1994 Lars-Jos, Jr. et al. ..... D2/610
5,511,241 A * 4/1996 Ziegler ..... 2/2.5
5,729,831 A * 3/1998 Kuhlmann ..... 2/16
5,862,521 A * 1/1999 van Marwijk et al. ..... 2/16
5,894,602 A * 4/1999 Smith et al. ..... 2/159
6,061,833 A * 5/2000 Smith et al. ..... 2/162
6,076,190 A * 6/2000 Besson ..... 2/161.6

FOREIGN PATENT DOCUMENTS

| | | |
|---|---|---|
| FR | 2 611 447 | 9/1988 |
| FR | 2 748 908 | 11/1997 |
| GB | 93 05 286 | 10/1993 |
| WO | WO 96/11595 | 4/1996 |

* cited by examiner

*Primary Examiner*—Peter Nerbun
*Assistant Examiner*—Katherine Moran
(74) *Attorney, Agent, or Firm*—Young & Thompson

(57) ABSTRACT

The invention concerns a metal mesh glove provided with a likewise metal mesh extension (3), designed to cover the user's wrist, forearm and optionally arm. The invention is characterised in that said extension (3) is equipped with a rigid projecting beaded edge (6) arranged over at least part of its periphery and adapted to prevent a tool blade sliding on the metal mesh from thrusting further forward. Said rigid beaded edge (6) consists of a directly mounted structure in the form of a directly mounted circular loop (8), made of a rigid material and made integral with the metal mesh fabric by any suitable means.

18 Claims, 3 Drawing Sheets

METAL MESH GLOVES

BACKGROUND OF THE INVENTION

This invention relates to metal mesh gloves that are made of interlaced metal ring meshes and that are suited for protecting hands, possibly the forearms and the arms of the user.

Metal mesh gloves are largely used on cutting stations in the meat industry as well as in any field where metal or glass sheets with sharp edges are handled.

Certain realisations are made of a metal mesh 'hand' section, extended by a forearm protection sleeve of moulded plastic. This sleeve generally contains an external return section at its end that forms an obstacle or a stop member to prevent the progress of a knife blade or other tool, towards the unprotected section of the forearm or arm.

These plastic sleeves ensure efficient protection of the limb, but their presence complicates the assembly of the glove during manufacture. They also cause perspiration problems for the user's limb and they are rather fragile.

To remedy these shortcomings, metal meshes fitted with a protection extension, also made of metal mesh, to cover the wrist and possibly the forearm and the arm of the user, have been suggested. At the end of this protection extension, a fastening member is designed for clamping purposes, or an add-on peripheral strap, made of braided fabric or of plastic fabric notably.

As foreseen in the document WO-A-96 11 595, the metal mesh protection glove may also comprise elastic clamping members in the form of spiral springs provided at the wrist and at the end of the protection extension, for holding the glove on the user's limb.

But if in these latter cases, the covered limb sections are protected efficiently when a tool blade slips on the metal mesh fabric; it may easily reach the end of the protection extension and injure the person at a non-covered section of the member, i.e. even in spite of an end clamping strap or an elastic spiral spring.

SUMMARY OF THE INVENTION

This invention suggests to remedy this shortcoming: it advises to this end to equip at least a portion of the periphery of the metal mesh protection extension, with a rigid protruding flange forming an efficient obstacle against the progress of a tool blade slipping on the metal mesh fabric, which flange is realised with an add-on circular buckle-shaped structure, of rigid fabric, joined to the metal mesh fabric by any appropriate means.

The thickness of this rigid flange ranges preferably between 1 and 1.5 cm. Preferably, it covers at least the larger section of the metal mesh extension periphery in order to provide efficient protection.

This flange is advantageously provided at the end of the metal mesh extension, but one or several other flanges can be provided between the said end and the 'hand' section of the glove.

According to a preferred embodiment, this glove comprises a metal mesh extension in the form of a complete sleeve deprived of lateral slots, which extension is fitted with a rigid protruding flange at its end, extending over at least a section of the periphery of the opening for inserting the hand.

According to a possible embodiment, the rigid protruding flange consists of a circular buckle that is added on undersizes or in a hem provided on the metal mesh extension.

According to another possibility, this flange consists of a circular buckle fitted with a number of orifices for fastening on the metal mesh fabric using metal junction rings.

The rigid circular buckle is advantageously shaped as a torus or a hooked section structure; it is made of rigid plastic or metal fabric; its section depends on the requested form and size of the end flange.

The rigid structure used may be in the form of an open buckle that may, after spreading, clamp the user's wrist, forearm or arm slightly. The ends of the buckle may overlap each other in order to avoid any exposed area, deprived from the safety flange. In the latter case, the overlapping buckle ends are shaped so that the thickness of the flange at the overlapping zone is not greater than the thickness of the said flange outside the said overlapping zone.

To improve the comfort of use, the peripheral area of the wrist or forearm that is located in the extension of the auricular may be deprived of a flange or it may include a thinner flange; this enables limiting the user's discomfort when he operates with his wrist or the forearm resting on a worktop, for example a cutting table.

Preferably, the metal mesh glove according to the invention also comprises at least one clamping member, for example in the form of a strap or a hook, at the wrist; possibly, stiffening members are provided between the said clamping member and the protruding end flange.

According to a particular embodiment, the glove is fitted with a metal mesh extension covering at least a portion of the user's forearm and it contains a first protruding flange at the wrist, as well as a second protruding flange on the forearm. Both these flanges are each made of an add-on buckle attached to the metal mesh extension and both add-on buckles are linked together by one or several rigid structure (s) forming one or several stiffening member(s) retaining the extension on the user's forearm.

BRIEF DESCRIPTION OF THE DRAWINGS

But the invention will be illustrated, without being limited thereto, by the following description of several particular embodiments, given solely for exemplification purposes and represented on the appended drawings on which.

DETAILED DESCRIPTION OF THE PREFERRED EMBODIMENTS

Figure 1:
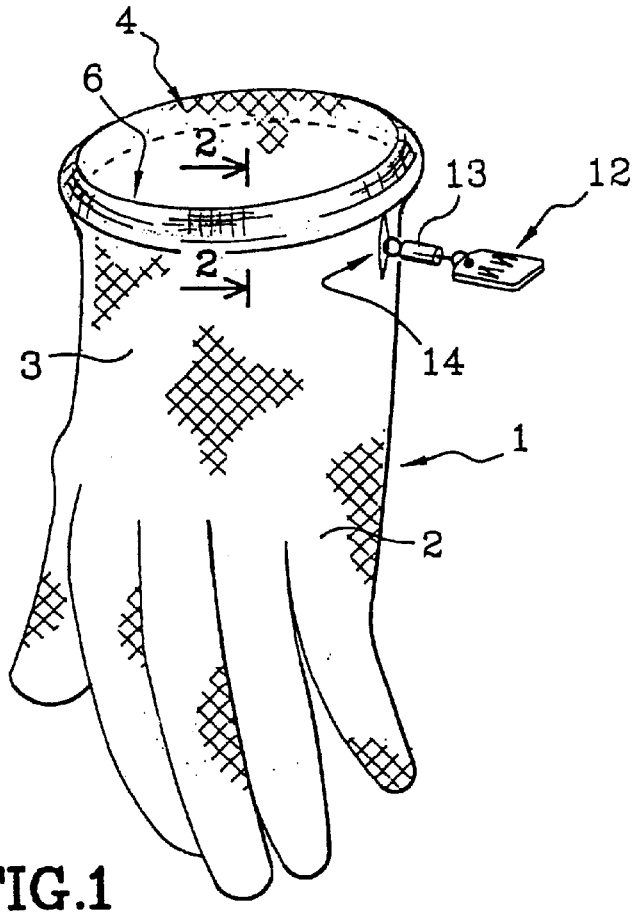
FIG. 1 shows a possible embodiment a metal mesh glove according to this invention, fitted with a protruding end flange.
Figure 2:
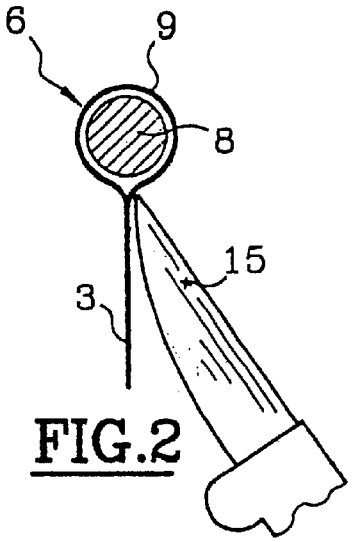
FIG. 2 is a cross sectional view along 2—2 of FIG. 1, which shows the protruding flange made of an add-on rigid circular buckle, housed in a hem provided in the metal mesh.

The glove 1 illustrated on FIGS. 1 and 2 is made of metal mesh fabric, consisting of interlaced metal ring meshes, for instance stainless steel wire rings with 0.5 or 0.55 mm diameter.

This glove consists of a 'hand' section 2 structured for enveloping the user's hand; this 'hand' section 2 is extended by a section 3, in the form of a sleeve suited to cover the wrist.

The metal mesh of the end section 3 can be oriented in the same direction as that covering the 'hand' section 2 or in a different direction.

The extension section 3 is in the form of a complete sleeve, without any lateral slots; its end opening 4 exhibits sizes that are barely sufficient to enable inserting the hand smoothly.

The end rim of the extension 3 that delineated the opening 4 for inserting the hand, comprises a peripheral flange 6 consisting of an add-on circular buckle 8, of rigid fabric, forming an insert housed inside a hem 9. This hem 9 is obtained by the combination of the line of end rings of the extension 3 with the body of the metal mesh fabric, preferably on the side of the external face of the said fabric in order to increase the outward protrusion. This combined arrangement uses a seam with metal rings that are identical or similar to those of the metal mesh fabric.

The end rim of the extension 3 that delineated the opening 4 for inserting the hand, comprises a peripheral flange 6 consisting of an add-on circular buckle 8, of rigid fabric, forming an insert housed inside a hem 9. This hem 9 is obtained by the combination of the line of end rings of the extension 3 with the body of the metal mesh fabric, preferably on the side of the external face of the said fabric in order to increase the outward protrusion. This combined arrangement uses a seam with metal rings that identical or similar to those of the metal mesh fabric.

The sizes of the hem 9 are adjusted in relation to those of the insert 8. The hem 9 can be formed directly on the insert 8, but the said insert can also slide into the end hem provided in anticipation thereof; in the latter case, a finishing seam enables complete partition of the insert for better retention.

It should be noted that instead of the hem 9, a number of simple metal mesh undersizes, spaced regularly, can be provided. Any other fastening mode may also be contemplated.

Figure 3:
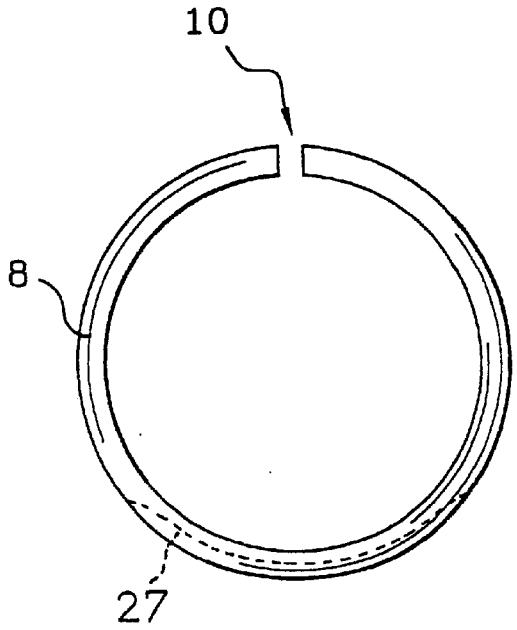
FIG. 3 shows the add-on circular buckle, isolated and seen from beneath.

The circular buckle 8, represented individually on FIG. 3, is generally O-shaped with a round section whose diameter ranges between 1 and 1.5 cm; it is made of rigid fabric, for example plastic (PVC, polyamide, polycarbonate . . . ) or of metal (stainless steel, aluminium . . . ).

It can be noted on FIG. 3 that the insert 8 does not form a complete buckle, it is open at the zone referred to as 10 and it thus forms, in connection with the nature of the fabric used, a flexible structure that may be open or spread apart slightly, notably to facilitate the passage of the hand into the opening 4 of the glove.

To complete the retaining system of the glove and to optimise the dressing of the protected limb section, a clamping member at the end of the 'hand' section 2 or on the extension part 3 can be provided. This clamping member can consist of an add-on metal mesh strap, of braided fabric, plastic or other; as represented on FIG. 1, a simple hooking structure 12 can also be provided, attached directly to the metal mesh fabric or via a sprocket-type assembly member 13. The hooking structure 12 that engages into the metal mesh fabric enables the user to adjust the clamping tightness at will.

Preferably, the clamping member 12 is attached to the rim of an opening 14 arranged in the metal mesh fabric. The clamping member 12 may then be positioned on either side of the metal weft, which produces a reversible glove by simply turning said glove over.

Once on the user's hand and wrist, the flange 6 forms a protruding end member whose size and rigid structure are suited to form an obstacle or an efficient barrier against the progress of a tool blade slipping on the metal mesh fabric. This protruding flange 6 extends over the whole periphery of the end opening 4 of the glove and it constitutes an efficient blocking member, thereby improving the safety of the glove against uncontrolled movements and untimely sideslips of the tool used.

FIG. 2 shows a tool blade 15 facing the safety flange 6. It can be easily understood that if that blade 15 progresses toward the unprotected limb section, the end flange 6 will block it to avoid any risks of injury or it will at least brake its progress and make it bounce to limit these risks.

It will also be noted that the rigid buckle positioned in the end hem enables opening the passage 4 for inserting the hand; this particularity facilitates putting on and removing the glove.

The safety hem 6 can be arranged in the same way at the end and/or on an area of the height of a metal mesh extension covering the user's forearm or even his arm. In such a case, the protection extension may comprise a number of clamping members in the form of straps and/or hooking structures; it may also be fitted with longitudinal stiffeners that would contribute to hold the metal mesh fabric better on the protected limb section.

Figure 4:
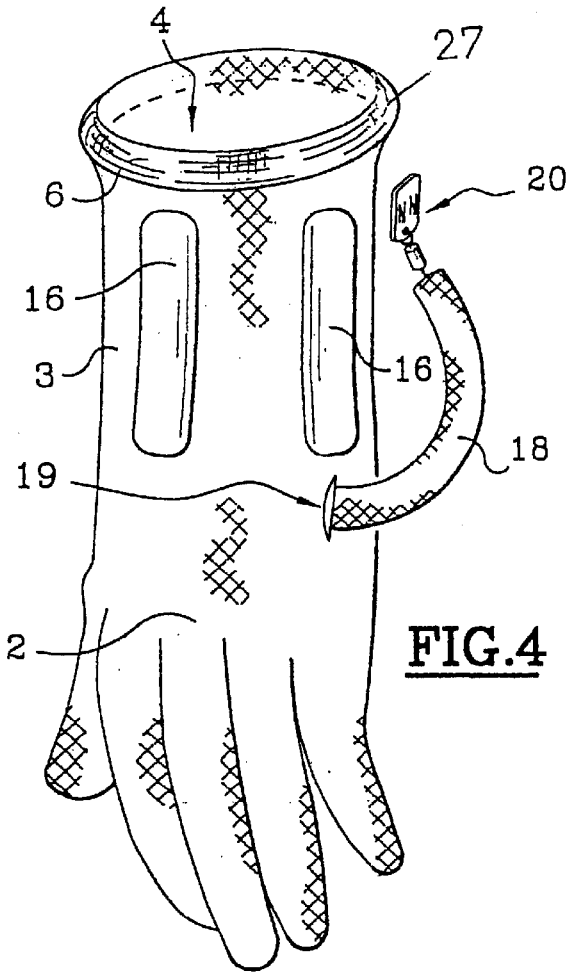
FIG. 4 shows another possible embodiment of a metal mesh glove according to this invention, in which the protruding flange is provided at the end of an extension intended for covering the user's forearm.

FIG. 4 shows such a metal mesh glove, whose 'hand' section 2 is continued by an extension 3 intended for covering the larger part of the forearm. This extension 3 comprises an end flange 6 identical or similar to that illustrated in connection with the 'simplified' glove of FIGS. 1 and 2. It also contains longitudinal stiffeners 16 realised notably by moulding plastic casting on the mesh formed of metal rings, or by metal elements fixed to the metal mesh fabric. These stiffeners 16 extend over the length of the extension 3, between the end flange 6 and a clamping strap 18 fitting the wrist area.

The clamping strap 18 consists of a metal mesh band fixed to the rim of an opening 19 enabling to turn the glove over; it is fitted at its end with a hooking member 20 for prolonged clamping.

Forms of circular buckles other than that illustrated on FIGS. 2 and 3 can be contemplated to realise the end flange 6.

Thus, although an open buckle is a preferred embodiment because of the flexibility provided by this characteristic, the use of a closed buckle can also be contemplated, notably if the presence of a zone deprived of inserts at the periphery of the end opening 4 is desirable.

An intermediate solution consists in providing a structure in the form of an open buckle whose ends overlap each other and may slip one over the other or slide in relation to one another, in relation to the flexibility obtained. In such a case, the ends of the buckle will be advantageously adapted to limit the thickness of matter involved in this overlapping. In particular, these ends could be formed so that the thickness of the flange 6 is more or less identical over the whole periphery of the opening 4 for inserting the hand.

Figure 5:
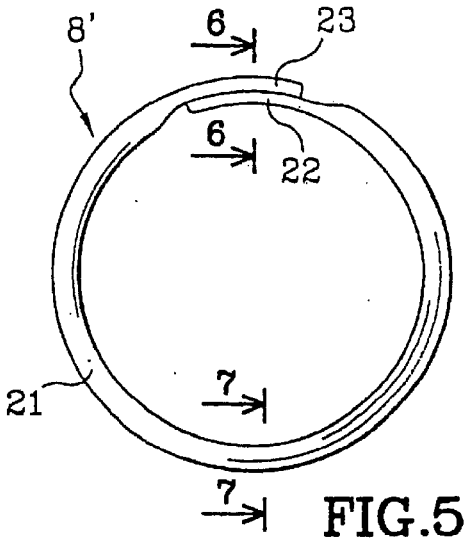
FIG. 5 shows another possible embodiment of the add-on circular buckle, isolated and see from above.
Figure 6:
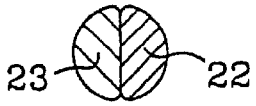
FIG. 6 is an enlarged sectional view along 6—6 of FIG. 5.
Figure 7:
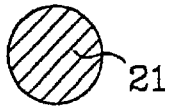
FIG. 7 is an enlarged sectional view along 7—7 of FIG. 5.

FIGS. 5, 6 and 7 show such a structure 8', consisting of a body 21 of round section and of two ends 22 and 23 that overlap each other. The thickness of both these ends 22 and 23 is smaller than that of the body 21; they exhibit a complementary form that, in combination, enables substantial reconstruction of the round section of this body 21.

The result is a buckle structure that, after spreading, resumes its initial configuration due to the flexibility of the rigid material.

Figure 8:
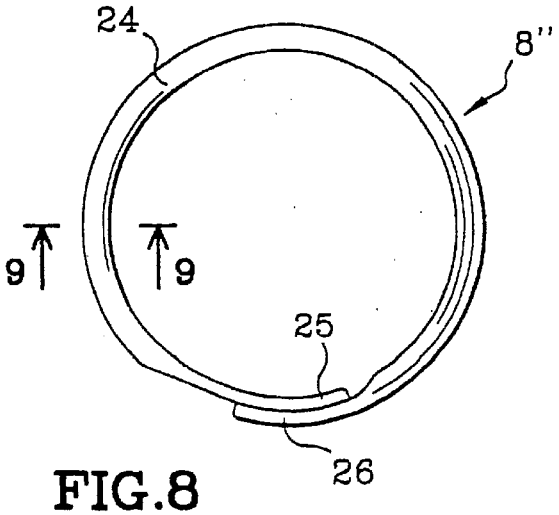
FIG. 8 shows still another possible embodiment of the add-on circular buckle, isolated and seen from above.
Figure 9:
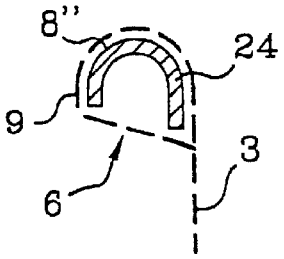
FIG. 9 is an enlarged sectional view along 9—9 of FIG. 8.

FIGS. 8 and 9 illustrate a slightly different embodiment in which the rigid structure 8" consists of a circular body 24 with a reverted U-section forming a kind of hook, extended by two flattened ends 25 and 26 that overlap each other. There again, the result is an open buckle of general circular shape with a flexible structure.

FIG. 9 represents the metal mesh fabric with the end hem 9 as a dotted line. This particular form of rigid buckle with hooked section enables efficient blockage of the progress of a tool blade and it improves the efficiency of the flange 6. Obviously, to be efficient, the hook provided externally is oriented towards the user's hand.

The protruding hem according to the invention can prove cumbersome in certain cases, for instance when the user rests his wrist or his forearm on a worktop. To limit this inconvenience, and to reach an acceptable compromise between safety and user's comfort, the peripheral zone of the wrist or the forearm that is situated in the extension of the auricular could be deprived of flange or the flange at that point could be limited in thickness.

The rigid buckle 8" illustrated on FIG. 8 exhibits this characteristic at both its flattened ends 25 and 26. For this thinner zone to be permanently positioned correctly in the alignment of the auricular (little finger portion), the add-on structure 8" could be made integral with the metal mesh hem 9, for example using one or several connection rings.

FIG. 3 shows on the circular structure 8, a dotted line 27 that illustrates the reduction in thickness that could be provided to meet the degree of comfort mentioned above.

Figure 10:
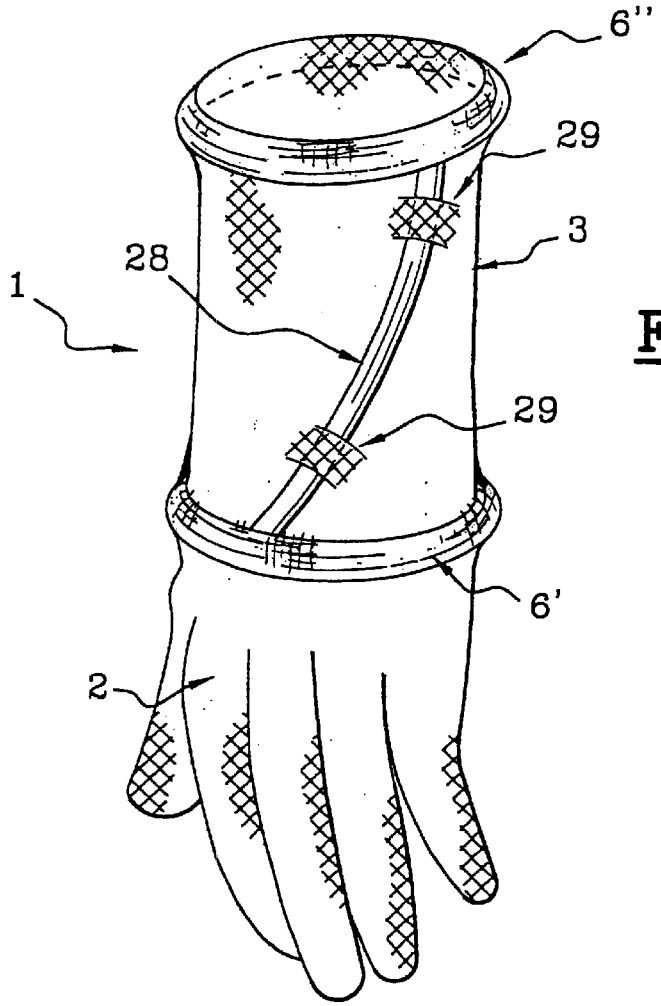
FIG. 10 shows a glove with a metal mesh extension covering the forearm, fitted with two protruding flanges connected by a rigid structure forming a stiffening section.

FIG. 10 shows another embodiment of a metal mesh glove according to this invention, fitted with an extension 3 covering the user's forearm section. This particular glove comprises a first protruding flange 6' at the wrist and a second protruding flange 6" at the end of the extension 3. Each flange 6' and 6" is realised using an add-on rigid circular insert, housed in an appropriate flange. At the wrist, the hem consists of a double metal mesh fabric or using a tubular section manufactured independently from the glove and fastened by sewing rings.

Between both flanges 6' and 6", a rigid structure 28 can be seen that makes up a stiffening member that enables stretching the extension 3 for holding it in position on the forearm. This stiffening member 28 can be independent of the structures that form the protruding flanges 6' and 6" or it can be made of a single block like them. As illustrated on FIG. 10, the form can be generally helicoidal in order to wrap at least partially around the forearm; a simpler form can also be contemplated, rectilinear for instance.

The stiffening member 28 is held integral with the metal mesh fabric forming the extension 3 by any appropriate means, for instance via small add-on metal mesh sections 29, making up kinds of undersizes spaced regularly. It can also be housed integrally in a longitudinal hem provided to this end or it can be fastened by sewing rings.

If needed, several stiffening members 28 can be provided at the periphery of the extension 3.

The rigid structures used to form the flanges 6' and 6" are of the same type as those described in connection with the embodiments of FIGS. 1 to 9. If the stiffening member(s) 28 are made of a single block with these structures, the fastening of the assembly on the metal mesh extension 3 should be suite accordingly.

The result is a metal mesh extension 3 shaped as a tube by a kind of rigid chassis. For better covering of the user's member, additional clamping means could be provided, not represented, as clamping straps and/or simple hooking members.

The same stiffening structure can be suited on the forearm and possibly the portion of a protection glove covering the whole upper limb of the user.

Figure 11:
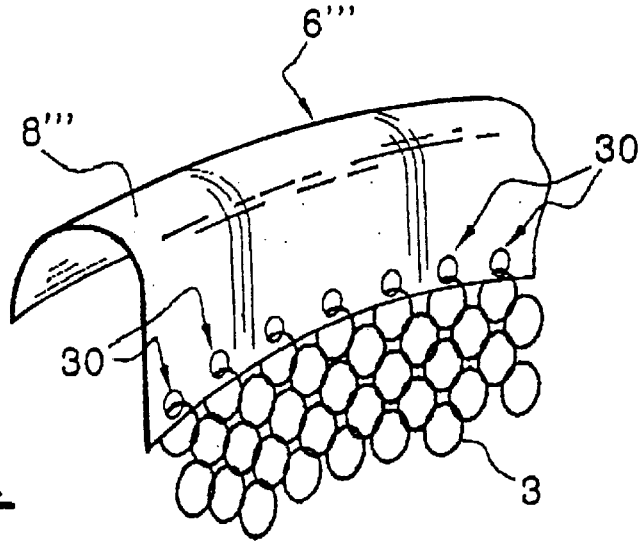
FIG. 11 is a perspective partial view illustrating another possible embodiment of the protection flange according to the invention.

FIG. 11 illustrates partially another possible embodiment of a protruding protection flange. Here, the flange 6''' consists of a circular buckle 8''' with a hooked section whose base comprises a number of orifices 30 for better integration with the metal mesh fabric, using metal junction rings that may be identical to those of the metal mesh fabric.

The rigid buckle with a hooked section 8''' can be made of metal or of plastic material; it can be arranged at the end of the metal mesh extension 3 or on an intermediate section. The hooking member extends externally, oriented to the 'hand' section of the glove to fulfil its function efficiently as a protection stop.

According to an embodiment variation, the protruding flange can have the form of two annular hooking structures similar to the representation of FIG. 11, arranged back to back. The result is a symmetrical structure with an internal hook and an external hook that render the glove reversible.

According to another embodiment variation, the hooked structure 8''' can be replaced with a toroidal buckle from which extends a lateral fin fitted with connection orifices.

The add-on rigid buckle 8''' can also be fastened to the metal mesh fabric by other means, for instance by rivets: it can also be open or closed according to the embodiments described above.

What is claimed is:

1. A metal mesh glove, comprising:

a metal mesh fabric extension for covering at least one of a wrist, a forearm, and an arm of a user; and at least one rigid protruding flange on at least one portion of a periphery of the extension for forming an obstacle to progress of a tool blade slipping on the metal mesh fabric, said at least one flange including an add-on circular buckle of rigid material, said circular buckle being joined to the metal mesh fabric and providing structural support for said at least one flange, wherein the circular buckle comprises a number of orifices, metal junction rings are connected to the orifices to fasten the circular buckle to the metal mesh fabric of the extension.

2. A metal mesh glove, comprising:

a metal mesh fabric extension for covering at least one of a wrist, a forearm, and an arm of a user; and at least one rigid protruding flange on at least one portion of a periphery of the extension for forming an obstacle to progress of a tool blade slipping on the metal mesh fabric, said at least one flange including an add-on circular buckle of rigid material, said circular buckle being joined to the metal mesh fabric and providing structural support for said at least one flange, wherein a thickness of the buckle at a peripheral zone of a wrist or a forearm that is in alignment with a little finger of a hand is smaller than a thickness of the buckle not at the peripheral zone.

3. The metal mesh glove according to claim 2, wherein the at least one rigid protruding flange does not protrude at a peripheral zone of a wrist or of a forearm that is in alignment with a little finger of a hand.

4. The metal mesh glove according to claim 2, further comprising a first protruding flange at a wrist of a user and a second protruding flange at a forearm of a user, each said first and second protruding flanges being attached to the metal mesh extension and being linked together by at least one stiffening member for retaining the extension on the user's arm.

5. A metal mesh glove, comprising:

a metal mesh fabric extension for covering at least one of a wrist, a forearm, and an arm of a user;

at least one rigid protruding flange on at least one portion of a periphery of the extension for forming an obstacle to progress of a tool blade slipping on the metal mesh fabric, said at least one flange including an add-on circular buckle of rigid material, said circular buckle being joined to the metal mesh fabric and providing structural support for said at least one flange; and at least one clamping means proximate the wrist of a user, for connecting the glove and the extension.

6. The metal mesh glove according to claim 5, wherein said at least one flange has a thickness in a range between 1 cm and 1.5 cm.

7. The metal mesh glove according to claim 5, wherein the at least one flange is at an end of the metal mesh extension.

8. The metal mesh glove according to claim 5, wherein the metal mesh extension is a complete sleeve deprived of any lateral slots, and wherein the end of the metal mesh extension comprises an opening for inserting a hand of a user, said at least one flange protruding to cover at least one portion of a periphery of said opening.

9. The metal mesh glove according to claim 5, wherein at least one flange is between a hand section of the glove and an end of the extension.

10. The metal mesh glove according to claim 5, wherein the add-on circular buckle is in a hem on the extension.

11. The metal mesh glove according to claim 10, wherein the circular buckle is generally toric in shape.

12. The metal mesh glove according to claim 11, wherein the circular buckle has first and second open ends.

13. The metal mesh glove according to claim 12, wherein the open ends of the buckle overlap each other.

14. The metal mesh glove according to claim 13, wherein the open ends are shaped so that a thickness of where the open ends overlap does not exceed a thickness of the buckle where the open ends do not overlap.

15. The metal mesh glove according to claim 10, wherein the circular buckle has a cross-section in a shape of a hook.

16. The metal mesh glove according to claim 5, wherein the clamping means comprises a strap.

17. The metal mesh glove according to claim 16, further comprising at least one stiffening member between the clamping means and the at least one flange.

18. The metal mesh glove according to claim 5, wherein the clamping means comprises a simple hooking structure.

* * * * *